US008006883B2

(12) United States Patent
Schell et al.

(10) Patent No.: US 8,006,883 B2
(45) Date of Patent: Aug. 30, 2011

(54) FASTENER DRIVER HAVING NOSEPIECE COVER

(75) Inventors: Craig A. Schell, Baltimore, MD (US); Ashok Samuel Baskar, Lutherville, MD (US); Paul G. Gross, White Marsh, MD (US); James J. Kenney, Baltimore, MD (US); Li Xu, Woodstock, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/622,501

(22) Filed: Nov. 20, 2009

(65) Prior Publication Data

US 2010/0065601 A1 Mar. 18, 2010

Related U.S. Application Data

(62) Division of application No. 11/050,280, filed on Feb. 3, 2005, now Pat. No. 7,641,089.

(60) Provisional application No. 60/559,342, filed on Apr. 2, 2004.

(51) Int. Cl.
*B25C 1/06* (2006.01)

(52) U.S. Cl. ..... 227/123; 227/8; 227/119

(58) Field of Classification Search ..... 227/8, 123, 227/119

See application file for complete search history.

(56) References Cited

U.S. PATENT DOCUMENTS

| | | | | |
|---|---|---|---|---|
| 618,085 | A | | 1/1899 | Grandy |
| 2,664,565 | A | | 1/1954 | Percoco |
| 3,174,672 | A | | 3/1965 | Juilfs |
| 3,615,049 | A | | 10/1971 | Obergfell et al. |
| 3,809,307 | A | * | 5/1974 | Wandel et al. ..... 227/8 |
| 3,822,816 | A | * | 7/1974 | Doyle ..... 227/83 |
| 3,834,602 | A | * | 9/1974 | Obergfell ..... 227/120 |
| 3,858,780 | A | * | 1/1975 | Perkins et al. ..... 227/8 |
| 3,893,610 | A | * | 7/1975 | Smith ..... 227/8 |
| 3,905,535 | A | * | 9/1975 | Novak et al. ..... 227/120 |
| 3,957,192 | A | * | 5/1976 | Fehrs ..... 227/123 |
| 4,194,664 | A | * | 3/1980 | Siegmann ..... 227/8 |
| 4,197,974 | A | | 4/1980 | Morton et al. |
| 4,323,127 | A | * | 4/1982 | Cunningham ..... 173/53 |
| 4,389,012 | A | | 6/1983 | Grikis et al. |
| 4,436,236 | A | * | 3/1984 | Jobe ..... 227/123 |
| 4,483,473 | A | | 11/1984 | Wagdy |
| 4,549,681 | A | * | 10/1985 | Yamamoto et al. ..... 227/8 |
| 4,624,401 | A | | 11/1986 | Gassner et al. |

(Continued)

FOREIGN PATENT DOCUMENTS

| | | |
|---|---|---|
| EP | 0100105 | 2/1984 |

*Primary Examiner* — Brian D Nash

(74) *Attorney, Agent, or Firm* — Harness, Dickey & Pierce, P.L.C.

(57) ABSTRACT

A cordless nailer is provided having a nosepiece assembly with improved features. The nosepiece assembly includes a driver retention feature that is provided to retain a drive blade from accidentally escaping the nailer. The nosepiece assembly includes a nosepiece, a nosepiece cover coupled to the nosepiece and moveable between a first closed position and a second open position. The nosepiece cover includes a surface formed on an end thereof, wherein at least one of the nosepiece and nosepiece cover forms a channel. A driver is disposed within the channel, wherein as the nosepiece cover is moved from the first closed position to the second open position, the surface of the nosepiece cover prevents the driver from moving from the channel.

5 Claims, 6 Drawing Sheets

U.S. PATENT DOCUMENTS 4,688,710 A 8/1987 Massari, Jr. et al.
4,717,060 A 1/1988 Cotta
4,801,062 A * 1/1989 Austin ..... 227/128
4,821,937 A * 4/1989 Rafferty ..... 227/8
4,903,880 A * 2/1990 Austin et al. ..... 227/8
5,197,647 A 3/1993 Howell
5,261,587 A * 11/1993 Robinson ..... 227/8
5,322,189 A 6/1994 Oda et al.
5,335,800 A 8/1994 Liu et al.
5,350,103 A * 9/1994 Monacelli ..... 227/8
5,385,286 A * 1/1995 Johnson, Jr. ..... 227/8
5,433,367 A 7/1995 Liu
5,839,638 A * 11/1998 Ronn ..... 227/8
5,975,399 A 11/1999 Oehri et al.
6,012,622 A 1/2000 Weinger et al.
6,036,072 A 3/2000 Lee et al.
6,056,181 A 5/2000 Chuang et al.
6,176,412 B1 1/2001 Weinger et al.
6,186,386 B1 2/2001 Canlas et al.
6,199,739 B1 3/2001 Mukoyama et al.
6,290,115 B1 9/2001 Chen et al.
6,296,167 B1 10/2001 Jen et al.
6,431,428 B1 8/2002 Chen et al.
6,592,014 B2 7/2003 Smolinski
6,644,530 B2 11/2003 Chen
6,651,862 B2 * 11/2003 Driscoll et al. ..... 227/123
D500,655 S 1/2005 Leasure
6,837,412 B2 1/2005 Lamb
6,857,547 B1 * 2/2005 Lee ..... 227/8
7,137,540 B2 11/2006 Terrell et al.
2002/0117531 A1 8/2002 Schell et al.
2003/0115738 A1 * 6/2003 Barlow et al. ..... 29/592
2005/0218175 A1 * 10/2005 Schell et al. ..... 227/8
2005/0242152 A1 11/2005 Ronconi
2006/0016843 A1 1/2006 Ishizawa et al.
2006/0091177 A1 * 5/2006 Cannaliato et al. ..... 227/8
2006/0249554 A1 * 11/2006 Butzen et al. ..... 227/130
2008/0308592 A1 * 12/2008 Schell et al. ..... 227/8

* cited by examiner

FASTENER DRIVER HAVING NOSEPIECE COVER

CROSS-REFERENCE TO RELATED APPLICATIONS

This application is a divisional of U.S. patent application Ser. No. 11/050,280 filed on Feb. 3, 2005 (now U.S. Pat. No. 7,641,089), which claims the benefit of U.S. Provisional Application No. 60/559,342, filed on Apr. 2, 2004. The entire disclosures of each of the above applications are incorporated herein by reference.

FIELD OF THE INVENTION

The present invention relates to a cordless nailer, and more particularly to a magazine assembly for a cordless nailer.

BACKGROUND OF THE INVENTION

Fastening tools, such as power nailers and staplers, are relatively commonplace in the construction trades. Often times, however, the fastening tools that are available may not provide the user with a desired degree of flexibility and freedom due to the presence of hoses and such that couple the fastening tool to a source of pneumatic power. Similarly, many features of typical fasteners, while adequate for their intended purpose, do not provide the user with the most efficient and effective function. Accordingly, there remains a need in the art for an improved fastening tool.

SUMMARY OF THE INVENTION

A nailer is provided having a magazine assembly with improved features. An improved latch mechanism for clearing nail jams is provided that reduces wear on the latch. A driver retention feature is provided to keep a nail driver and a nail aligned and to constrain buckling loads. A pusher assembly is provided having a simplified and efficient construction. A pusher retention feature is provided that allows the pusher assembly to move behind nails loaded in the magazine assembly. A nail retention feature is provided to allow easy loading and unloading of nails into the nailer. Finally, a method of assembling the magazine assembly is provided.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
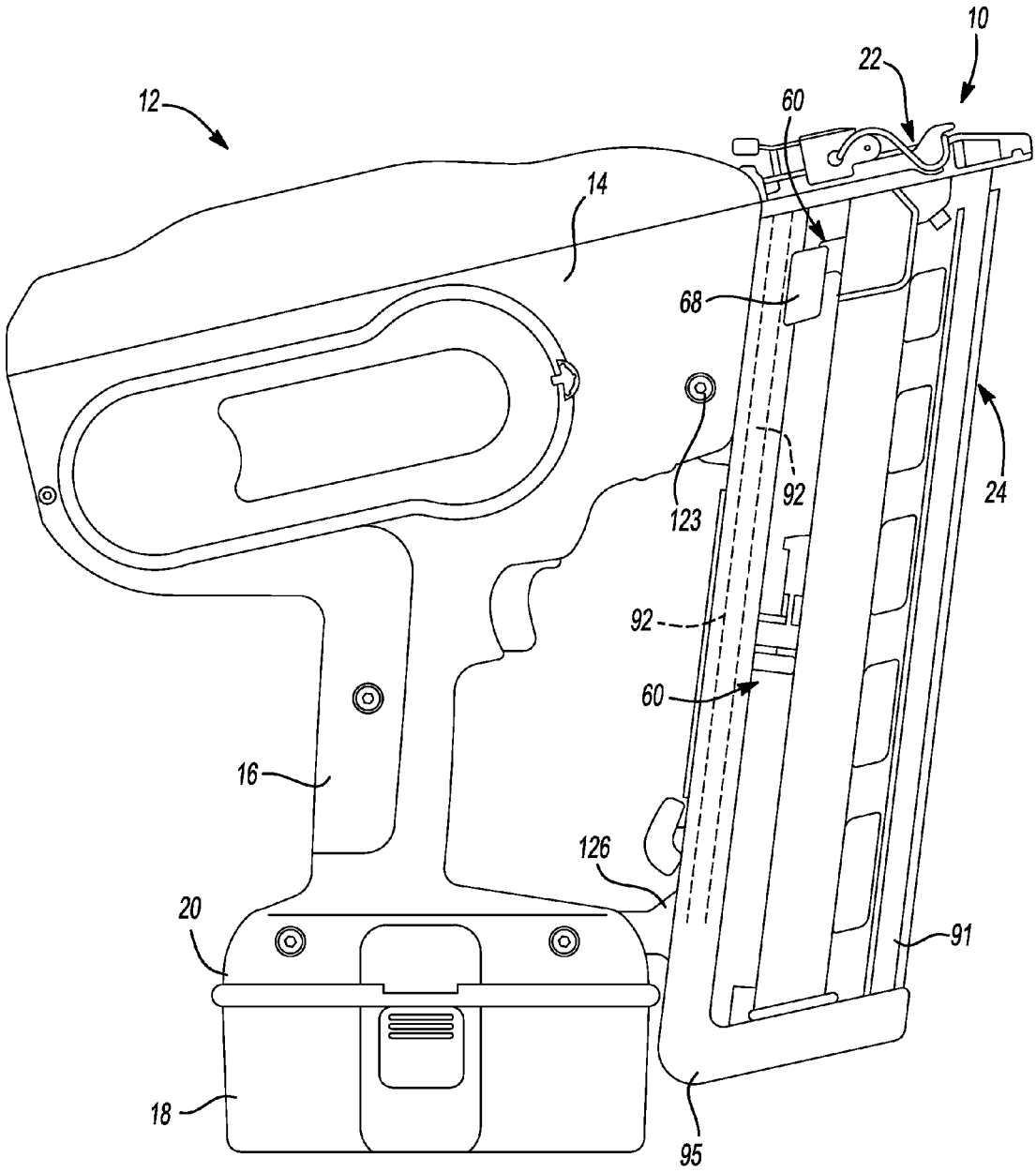
FIG. 1 is a side view of an exemplary nailer having a magazine assembly constructed according to the principles of the present invention.

With reference to FIG. 1, a magazine assembly 10 constructed according to the principles of the present invention is shown in operative association with an exemplary cordless nailer 12. It should be appreciated, however, that the present invention may be employed with various other nailers. The cordless nailer 12 generally includes a housing 14 with a motor (not shown) located therein. The motor drives a nail driving mechanism for driving nails (not shown) from the magazine assembly 10. A handle 16 extends from the housing 14 and terminates in a battery pack 18. The battery pack 18 is configured to engage a base portion 20 of the handle 16 and provides power to the motor.

The magazine assembly 10 includes a nosepiece assembly 22 and a magazine 24. The nosepiece assembly 22 is mounted to the housing 14. The magazine 24 is coupled to the nosepiece assembly 22 at one end thereof and is mounted to the base 20 of the handle 16 at an opposite end thereof.

Figure 2:
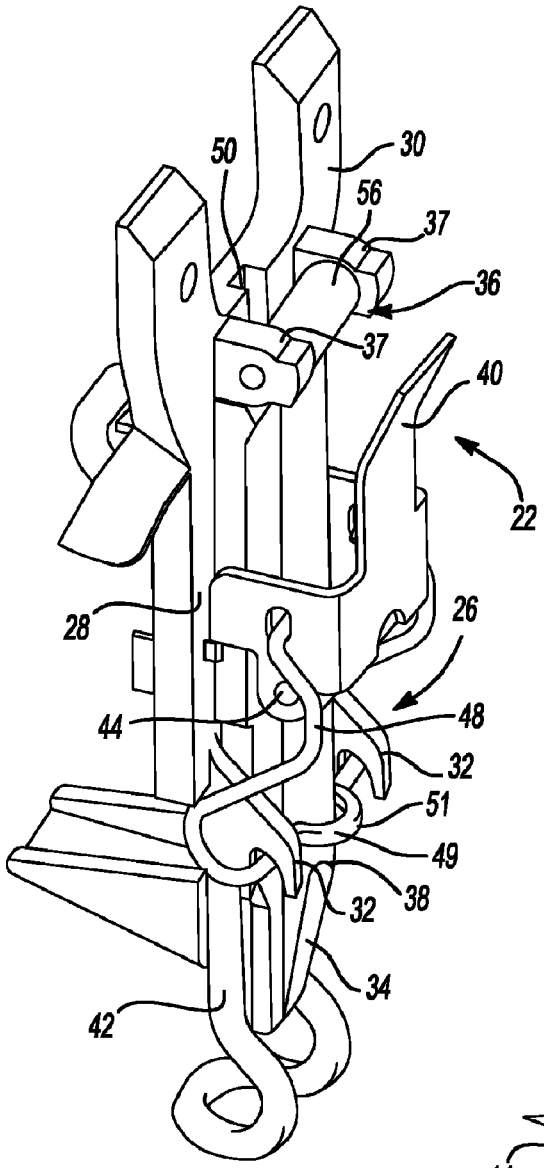
FIG. 2 is a perspective view of a nosepiece of the nailer having a latch mechanism used with the magazine assembly of the present invention.

Turning to FIG. 2, the nosepiece assembly 22 includes a latch mechanism 26 having an improved design. The nosepiece assembly 22 includes a nosepiece 28 that is mounted to a backbone structure (not shown) within the housing 12 (FIG. 1) at an end 30 thereof. The nosepiece 28 includes a pair of hooks 32 that extend upwards therefrom. A nose cover 34 is pivotally mounted to the nosepiece 28 near the end 30 at a pin connection 36 extending between a pair of lugs 37. The nose cover 34 extends along the length of the nosepiece 28 between the hooks 32. The nose cover 34 includes a rib 38 that extends along its length. The rib 38 provides strength to the nose cover 34 and provides a line-of-sight for the operator of the nailer 12 to align the nails (not shown). The nosepiece 28 and the nose cover 34 define a channel (as will be described in greater detail below) that receives a nail therein.

Figure 3:
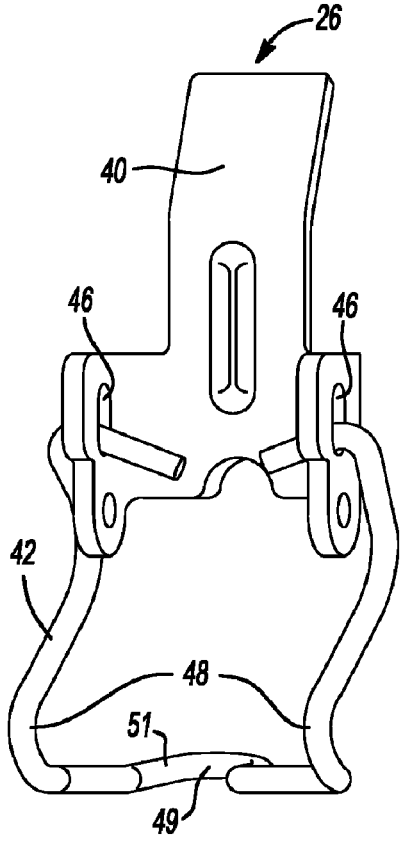
FIG. 3 is a back perspective view of a latch wire and latch tab used with the latch mechanism of the present invention.

The latch mechanism 26 is mounted to the nose cover 34 and includes a latch tab 40 and a latch wire 42, as best illustrated in FIG. 3. The latch mechanism 26 is used to lock and unlock the nose cover 34 to the nosepiece 28. The latch tab 40 is pivotally connected to the nose cover 34 at pin 44.

With reference to FIG. 3, the latch wire 42 is pivotally coupled to the latch tab 40 at enlarged slots 46. The enlarged slots 46 allow the latch wire 42 to be easily installed on the latch tab 40 and to eliminate the need for swaging the latch wire 42 into the slots 46. The latch wire 42 has a pair of parallel "s" shaped arms 48 (viewed from the side) which may be perpendicular to a center portion 49. It should be appreciated that various other shapes having the "s" shaped arms 48 may be employed. The center portion 49 has a hump portion 51 sized to fit over the rib 38 (as best seen in FIG. 2).

With reference to FIGS. 2 and 3, when the nose cover 34 is in its locked position over the nosepiece 28, the latch wire 42 is locked firmly within the hooks 32 of the nosepiece 28. The center portion 49 in turn presses firmly down upon the nose cover 34 on each side of the rib 38. This assures that the nose cover 34 is tightly engaged to the nosepiece 28. To unlock the nose cover 34, the latch tab 40 is urged away from the nose cover 34. This in turn disengages the latch wire 42 from the hooks 32, thus allowing the nose cover 34 to pivot about the pin connection 36 away from the nosepiece 28. In the unlocked position, an operator may then clear any nail jams within the nosepiece assembly 22.

Figure 4:
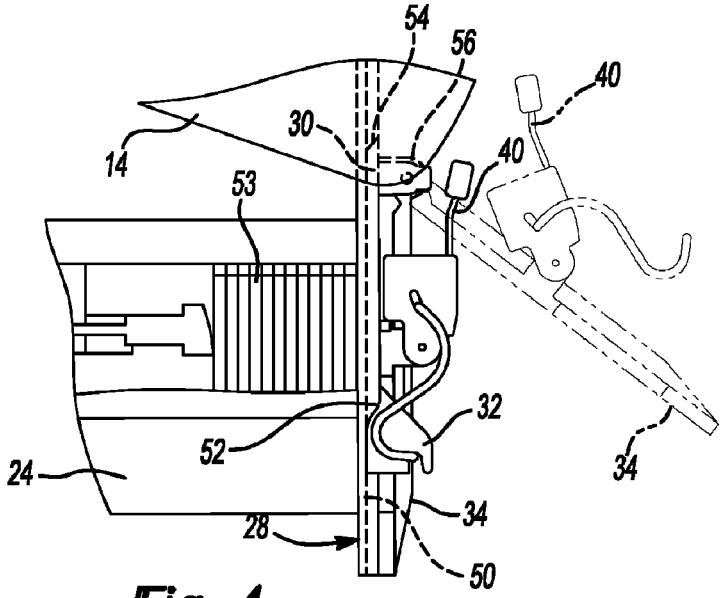
FIG. 4 is a side view of the nosepiece having a driver blade and nail retention mechanism used with the magazine assembly of the present invention.

Turning now to FIG. 4, a driver retention feature will be described. The nosepiece 28 includes a groove 50 formed therein that cooperates with the nose cover 34 (when the nose cover 34 is in its locked position) to form a channel 52. The channel 52 is sized to receive a nail 53 from the magazine 24. A driver blade 54 extends from the housing 14 into the channel 52. The driver blade 54 is driven by the motor and nail driver mechanism (not shown) and engages the head of the nail 53 to drive the nail 53 through the nosepiece 28 and out of the nailer 12.

However, when the nose cover 34 is in its unlocked position (shown in dashed lines in FIG. 4), the driver blade 54 may escape the groove 50. Accordingly, the nose cover 34 includes a cam portion 56 (best seen in FIG. 2) formed at an end thereof on an opposite side of the pin connection 36. As the nose cover 34 is moved to its unlocked position, the cam portion 56 engages the driver blade 54, thereby constraining the driver blade 54 to the groove 50 and preventing the driver blade 54 from escaping.

Turning back to FIG. 1, the magazine 24 holds a plurality of nails (not shown) therein. The nails are fed forward into the nosepiece assembly 22 by a pusher assembly 60. The pusher assembly 60 rides within the magazine 24 and protrudes partially therefrom to be engaged by the operator of the nailer 12.

Figure 5A:
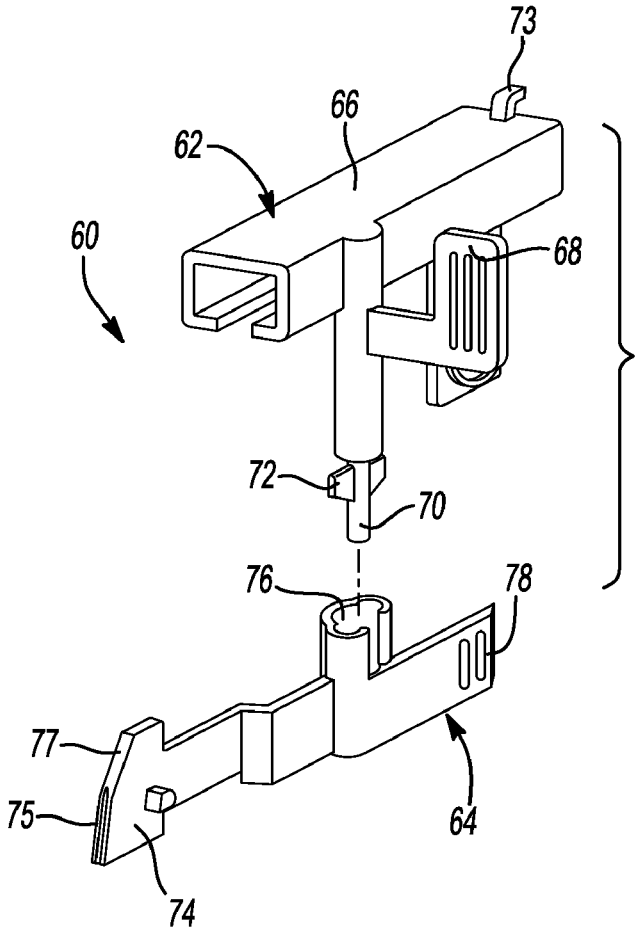
FIG. 5A is a perspective disassembled view of a nail pusher used with the magazine assembly of the present invention.

Turning to FIG. 5A, the pusher assembly 60 includes a runner portion 62, a pusher portion 64 and a spring member 80 that, at most, constitute three members to provide a simplified assembly that can be put together without tools. The runner portion 62 includes a runner 66 having a channeled portion sized to fit and slide on a liner (described in detail herein below) of the magazine 24 (FIG. 1). A handle 68 extends out from the runner 66 and out from the magazine 24. A pin 70 extends out from the runner 66 and includes a bayonet portion 72. A hook 73 extends out from the runner 66 and receives a portion of a biasing member, as will be described below. The upper portion 62 is a one piece unitary structure.

The pusher portion 64 includes a pusher 74 that engages the nails (not shown) to move them towards the nosepiece assembly 22 (FIG. 1). The pusher 74 includes a hole 76 sized to receive the pin 70 and bayonet portion 72 therein for providing a bayonet connection therebetween. An arm 78 extends out from the pusher 74 on an opposite side of the hole 76. The runner portion 62 and the pusher portion 64 are coupled together by inserting the pin 70 into the hole 76 such that the bayonet portion 72 locks the runner portion 62 to the pusher portion 64. The pusher portion 64 is a one piece unitary structure.

Figure 5B:
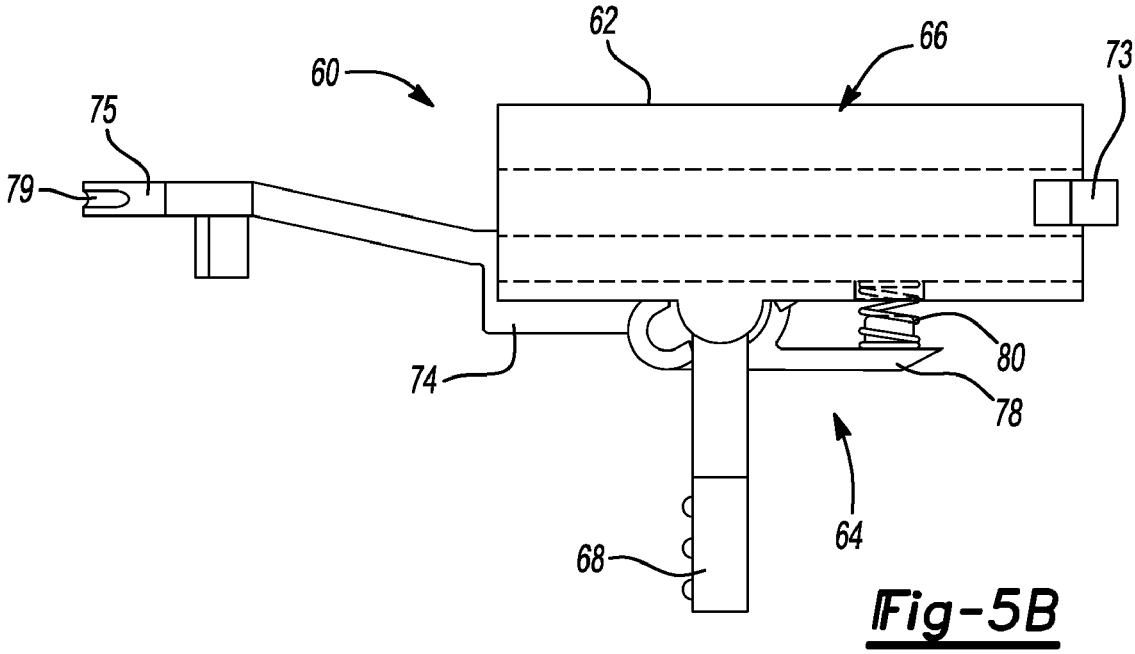
FIG. 5B is a top view of the nail pusher of FIG. 5A.

The pusher 74 includes a first surface 75 and a second surface 77. The first surface 75 is angled with respect to the second surface 77 and includes a notch 79 formed therein, as best seen in FIG. 5B. The notch 79 is configured to partially receive nails (not shown) therein (this can best be seen in FIG. 6B). The second surface 77 is angled to allow the driver blade 54 (FIG. 4) to strike the second surface 77, thereby moving the pusher assembly 60 out of the way of the driver blade 54 during a stroke of the driver blade 54.

With reference to FIG. 5B, the pusher assembly 60 further includes a biasing member 80 such as, for example, a spring. The biasing member 80 is mounted between the runner 66 and the arm 78 to bias the pusher 74 such that the bayonet portion 72 cannot be accidentally disengaged from the hole 76. Moreover, the biasing member 80 biases the pusher 74 to be in alignment with the nails (not shown) loaded within the magazine 24 (FIG. 1).

Figure 6A:
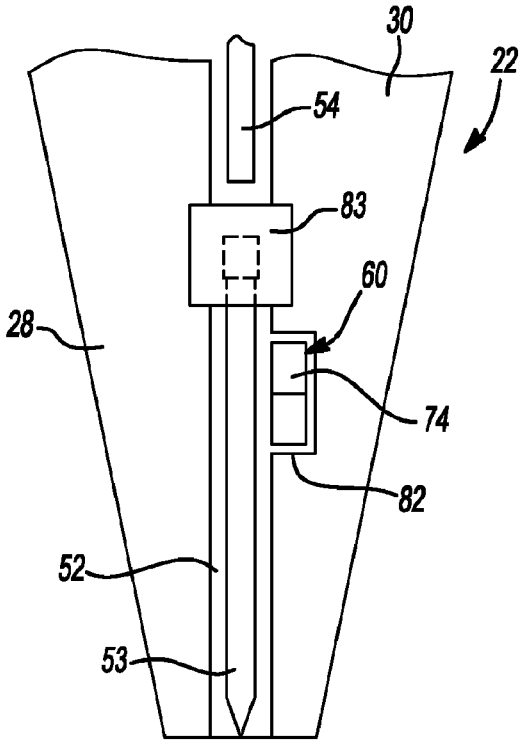
FIG. 6A is a front view of the nosepiece having a nail pusher pocket feature used in the magazine assembly of the present invention.

Turning to FIG. 6A, as noted above, the pusher assembly 60 slides within the magazine 24 (FIG. 1) to drive the nails 53 into the channel 52 of the nosepiece assembly 22. However, when all the nails 53 have been expended from the magazine 24, the pusher 74 enters the channel 52. If nails have been loaded into the magazine 24 while the pusher 74 of the pusher assembly 60 is located within the nosepiece 28, the pusher 74 would force the nails back until such time as the pusher 74 is no longer within the nosepiece 28 and the pusher 74 may move out of alignment with the loaded nails. Accordingly, the channel 52 includes a pusher pocket 82 formed therein and sized to receive the pusher 74. This allows the pusher 74 to be moved out of alignment with the loaded nails when the pusher 74 is within the nosepiece 28.

Figure 6B:
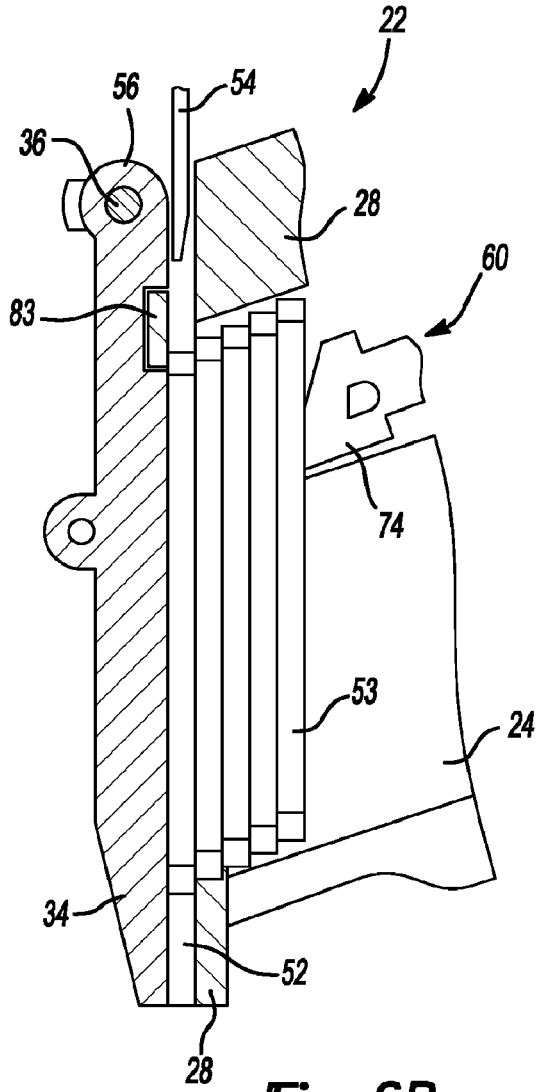
FIG. 6B is a side sectional view of the nosepiece having a nail stop used in the magazine assembly of the present invention.

The nosepiece 28 further includes a nail stop 83 that bridges the channel 52. As best seen in FIG. 6B, the nail stop engages each nail 53 as they are pushed by the pusher 74. This assures that the head of the nail 53 within the channel 52 is aligned with the driver blade 54. Moreover, the nail stop 83 prevents any buckling that may occur as the driver blade 54 strikes the nails 53. The nail stop 83 is formed as part of the nosepiece 28 as a single unitary structure. This integrated nail stop 83 and nosepiece 28 reduces manufacturing costs.

Turning to FIGS. 7A-D, loading and unloading of the magazine 24 will now be described. The magazine 24 includes a nail track 90 that is sized to accept a plurality of nails 53 (FIG. 6B) therein. The nails 53 are supported on one end thereof within the liner 42 at another end thereof with a lower magazine (further described below) which forms part of the magazine 24. The nails 53 slide up the magazine 24 towards the nosepiece assembly 22 (FIG. 1) by the pusher assembly 60. As noted above, the pusher assembly 60 slides along a portion of the magazine 24, specifically, along a liner 92 shown in FIG. 1.

Figure 7A:
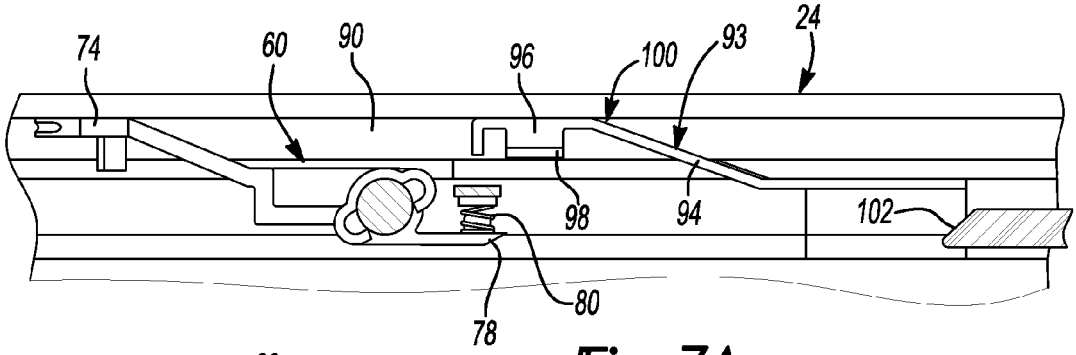
FIG. 7A is a top view of a nail retention system used in the magazine assembly of the present invention in an unlocked position.
Figure 7B:
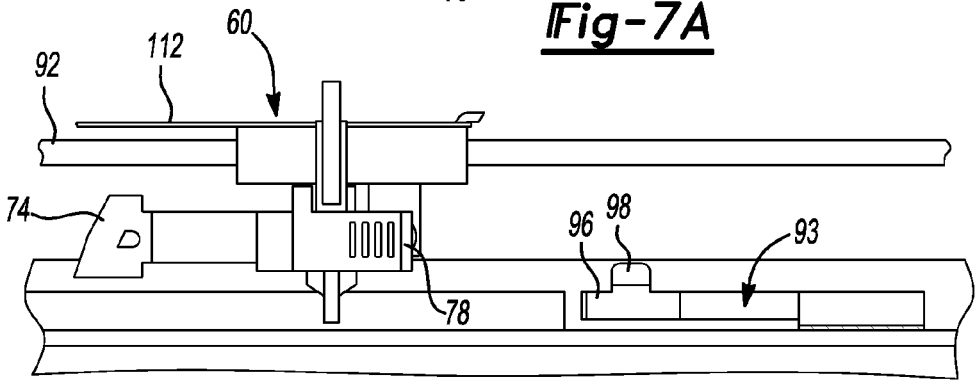
FIG. 7B is a side view of the nail retention system shown in FIG. 7A.

Nails 53 are loaded into the nail track 90 of the magazine 24 by inserting them into the nail track 90 through an opening (not shown) in the back of magazine 24. In order to keep the nails 53 within the nail track 90, the magazine 24 further includes a nail retaining spring 93 (FIGS. 7A and 7C) mounted therein. The nail retaining spring 93 acts as a one way valve to allow nails 53 to enter the nail track 90 while preventing them from exiting. Specifically, the nail retaining spring 93 includes a spring arm 94 fixed to the magazine 24 at one end thereof and a head portion 96 at a free end thereof. The head portion 96 is aligned with the nail track 90 when in an unbiased condition (e.g., when the spring arm 94 has not been fully deflected from its rest position), as shown in FIG. 7A. The head portion 96 includes an alignment tab 98 sized to engage a portion of the pusher assembly 60, as will be described below.

The spring arm 94 and the head portion 96 cooperate to form an inclined surface 100 such that nails 53 introduced into the magazine 24 will deflect the nail retaining spring 93 out of the way. The nail retaining spring 93 then snaps back into place, thereby preventing the nails 53 from accidentally exiting the magazine 24.

Figure 7C:
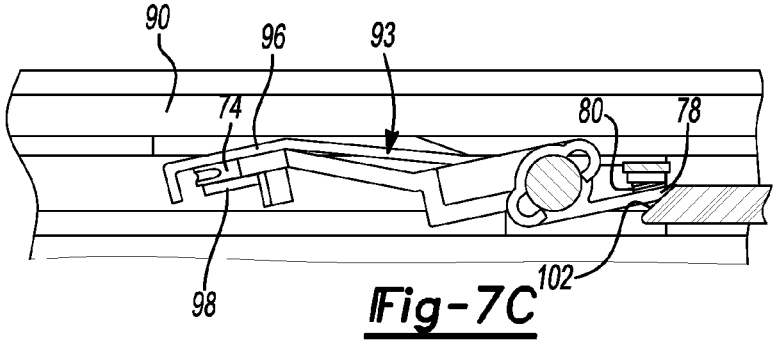
FIG. 7C is a top view of the nail retention system of FIG. 7A in a locked position.
Figure 7D:
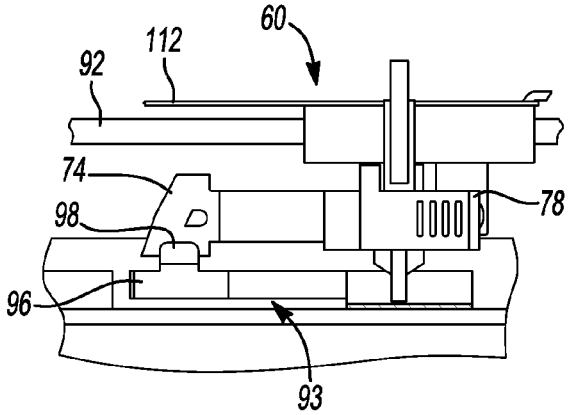
FIG. 7D is a side view of the nail retention system shown in FIG. 7C.

In order to load or unload the magazine 24, the pusher assembly 60 is moved to the back of the magazine 24. The rear arm 78 of the pusher assembly 60 then engages a cam surface 102 (FIG. 7C) in the magazine 24 near the back thereof (specifically located on a portion of the magazine 24 as seen in FIG. 8). Simultaneously, the alignment tab 98 moves into alignment with the pusher 74, as seen in FIGS. 7C and 7D. The cam surface 102 and the arm 78 cooperate to rotate the pusher 74 out of alignment with the nail track 90, as seen in FIG. 7C, against the force of the biasing member 80. This rotation is transferred to the nail retaining spring 93 through the alignment tab 98. Accordingly, the nail retaining spring 93 is moved out of alignment with the nail track 90 by the pusher 74. Nails 53 may then freely exit (or enter) the nail track 90 without interference. In this way, the pusher assembly 60 cooperates with the nail retaining spring 93 to allow the magazine to be loaded in either a "load and draw" mode (e.g., wherein, nails are first inserted in the magazine 24 and then the pusher assembly 60 is then "rotated" out of the plane of the nail track 90 upon contact with the nails and drawn behind the loaded nails) or in a "cock and load" mode (e.g., wherein, the pusher assembly 60 is drawn to the back of the magazine and cocked out of alignment with the nail track 90 by the cam surface 102 thereby allowing nails to be loaded and unloaded without restriction).

Figure 8B:
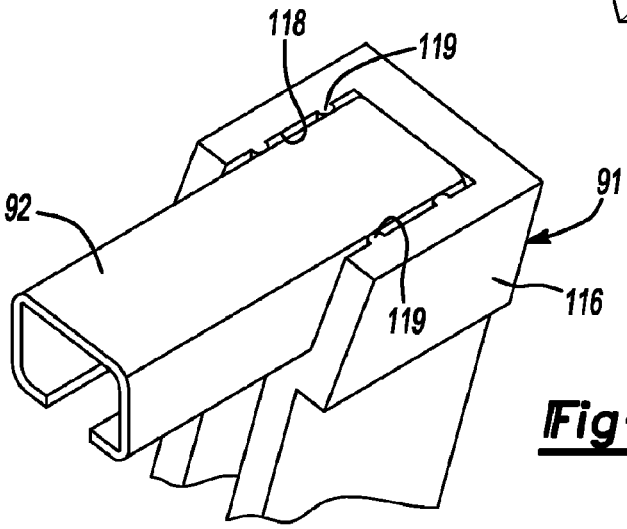
FIG. 8B is an enlarged perspective view of the area indicated by circle 8B-8B in FIG. 8A.
Figure 8A:
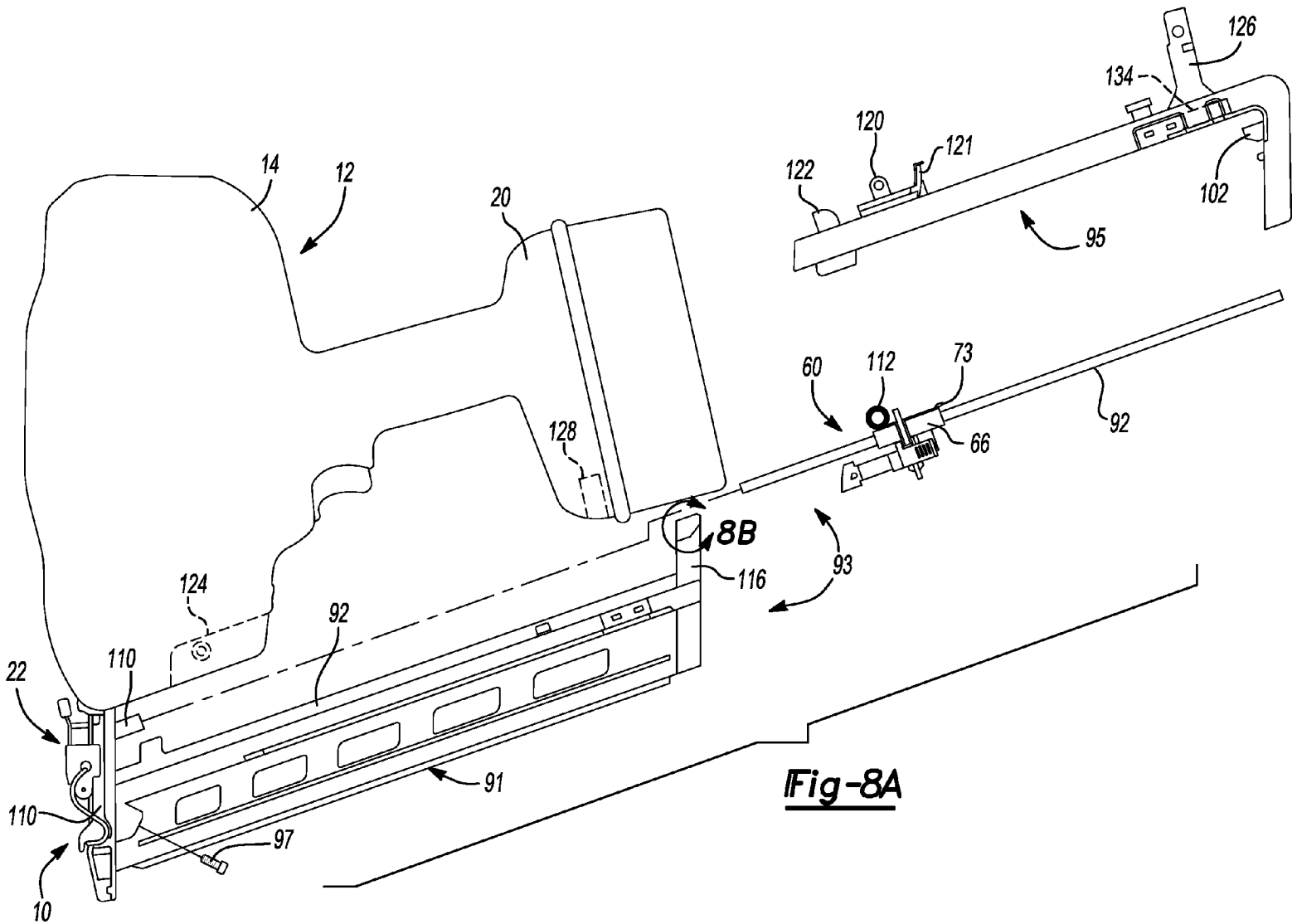
FIG. 8A is an expanded side view of the magazine assembly of the present invention illustrating a method of assembling the magazine assembly.

Turning now to FIG. 8A, the assembly of the magazine assembly 10 will be described. As noted previously, the nosepiece assembly 22 is fixed to a backbone structure (not shown) within the housing 14 of the nailer 12. The magazine 24 generally includes the liner (or guide) 92, a lower magazine 91, and an upper magazine 95.

First, the lower magazine 91 is coupled to the nosepiece assembly 22 near the lower end of the nosepiece assembly 22. In the particular example provided, screws 97 are used to couple the lower magazine 91 to the nosepiece assembly 22, although various other methods may be employed.

Next, the liner 92 is inserted into a receiver 110 in the nosepiece assembly 22 from the back thereof. The pusher assembly 60 is coupled to the liner 92 such that the runner 66 slidingly engages the liner 92. A constant force spring 112 (in the form of an axle-free rolled memory-type sheet steel) is then hooked onto hook 73 of the pusher assembly 60. The constant force spring 112 engages a portion of the magazine 24 as will be described below and biases the pusher assembly 60 towards the nosepiece assembly 22. The liner 92 is then coupled to a base portion 116 on the lower magazine 91. As seen in FIG. 8B, the base portion 116 on the lower magazine 91 includes a slot 118 for receiving an end of the liner 92 therein. The slot 118 includes a plurality of ribs 119 that engage the liner 92 and create a snap-fit or tight engagement therebetween. Alternatively, the base portion 116 may include a hole (not shown) sized to receive the liner 92 therein, or may include any other means of locking the liner 92 to the lower magazine 91.

Returning to FIG. 8A, the liner 92 and lower magazine 91 cooperate to form a fixed subassembly 93. The upper magazine 95 is then inserted overtop of the base portion 116 of the lower magazine 91 and overtop of the liner 92. Specifically, the upper magazine 95 includes a screw receiver 120 extending therefrom with a wall 121 formed near the screw receiver 120. The screw receiver 120 is sized to fit within an opening 124 formed in the housing 14 of the nailer 12. A screw 123, as seen in FIG. 1, extends through the housing 14 and engages the screw receiver 120, thereby securing the upper magazine 95 to the nailer 12. The wall 121 aligns with the opening 124 thereby covering the opening 124.

The upper magazine 95 further includes a spring retainer 122 extending therefrom. The spring retainer 122 has a cup shape and is sized to receive and secure the rolled portion of the constant force spring 112 therein. As the pusher assembly 60 is drawn away from the nosepiece assembly 22, the constant force spring 112 acts to bias the pusher assembly 60 towards the nosepiece assembly 22.

A ribbed flange 126 extends out from the upper magazine 95 and engages a matching ribbed recess 128 formed in the base 20 of the nailer 12 as the upper magazine 95 is coupled to the lower magazine 91 and the housing 14. The ribbed flange 126 lends structural support to the magazine assembly 10 when assembled. Moreover, the upper magazine 95 includes ramps 134 formed therein for aligning the liner 92 when the upper magazine 95 is coupled overtop the subassembly 93. In this way, the components of the subassembly 93 are fixed automatically during alignment thereof to reduce the number of components that must be held in place manually by an individual.

The method of assembling the magazine assembly 10 allows a user to quickly and efficiently do so by creating subassemblies which aid alignment. Moreover, engagement of the parts of the magazine 24 within receivers and apertures allows for quick and easy alignment of the parts.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A retainer assembly in a tool comprising:

a nosepiece;

a nosepiece cover coupled to the nosepiece and moveable between a first closed position and a second open position, the nosepiece cover including a surface formed on a proximal end thereof, at least one of the nosepiece and nosepiece cover forming a guide channel between said nosepiece and said nosepiece cover wherein a distal end of said nosepiece cover opposes a distal end of said nosepiece where a nail exits said guide channel;

a driver disposed within the guide channel;

wherein the nosepiece cover is pivotally movable from the first closed position to the second open position, and in the second open position, the surface of said nosepiece cover continues to block said guide channel and thereby prevents the driver from moving from said guide channel.

2. The retainer assembly according to claim 1, wherein said surface of said nosepiece cover maintains a generally constant distance from said nosepiece when said nosepiece cover is moved from the first closed position to the second open position.

3. The retainer assembly according to claim 1, wherein said nosepiece includes a pair of lugs for pivotally supporting said nosepiece cover therebetween.

4. A nosepiece assembly for use in a nailer tool comprising:

a nosepiece having a base portion;

a nosepiece cover attached to said nosepiece, at least one of said nosepiece and said nosepiece cover defining a channel formed therein adapted to receive nails therein;

a driver extending within the channel and adapted to engage a head of the nails; and a bridge extending from said base portion of said nosepiece and across the channel;

wherein the bridge and the base portion are formed as a single unitary member; and wherein said nosepiece cover is pivotally attached to said nosepiece and includes a cam surface formed on an end thereof wherein the nosepiece cover is movable from a closed position to an open position and when said nosepiece cover is in said open position, the cam surface continues to block said guide channel and thereby prevents said driver from moving from said channel.

5. The nosepiece assembly according to claim 4, wherein said nosepiece cover has a recess portion in a face thereof for receiving said bridge of said nosepiece.

* * * * *